US012599262B2

(12) United States Patent
Sitarz

(10) Patent No.: US 12,599,262 B2
(45) Date of Patent: Apr. 14, 2026

(54) METHOD AND APPARATUS FOR USE IN APPLYING PANTS TO THE LEGS OF A WEARER

(71) Applicant: Robert L. J. Sitarz, Oakbank (CA)

(72) Inventor: Robert L. J. Sitarz, Oakbank (CA)

( * ) Notice: Subject to any disclaimer, the term of this patent is extended or adjusted under 35 U.S.C. 154(b) by 82 days.

(21) Appl. No.: 18/433,768

(22) Filed: Feb. 6, 2024

(65) Prior Publication Data

US 2024/0306832 A1 Sep. 19, 2024

Related U.S. Application Data

(60) Provisional application No. 63/443,479, filed on Feb. 6, 2023.

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/905
See application file for complete search history.

(56) References Cited

U.S. PATENT DOCUMENTS

| | | | | |
|---|---|---|---|---|
| 3,401,856 | A * | 9/1968 | Berlin | A47G 25/905 223/111 |
| D458,005 | S * | 6/2002 | Bourton | D2/641 |
| 7,234,616 | B2 * | 6/2007 | Thom | A47G 25/905 223/111 |
| 9,282,840 | B2 * | 3/2016 | Moscato | A47G 25/905 |
| 11,213,154 | B1 * | 1/2022 | Timothy | A47G 25/90 |
| 2007/0119882 | A1 * | 5/2007 | Scott | A47G 25/907 223/111 |
| 2015/0136815 | A1 * | 5/2015 | Clifton | A47G 25/90 223/112 |

* cited by examiner

*Primary Examiner* — Ismael Izaguirre
(74) *Attorney, Agent, or Firm* — Adrian D. Battison; Ade & Company Inc; Ryan W. Dupuis

(57) ABSTRACT

An arrangement for applying pants to the legs of a wearer includes a semi-rigid elongate body formed of a thin smooth sheet having an upper end and a lower end and is convex in transverse cross-section so that the body engaging the front face holds the pant leg open for insertion of a foot of the wearer. The body has a length to extend from the crotch of the pants at least to the knee of the pant leg and has a hand grasping portion at or adjacent the upper end by which the body can be manually maneuvered into the pant leg to hold open the pant leg and to protect the pant leg from damage during insertion of the foot.

18 Claims, 5 Drawing Sheets

METHOD AND APPARATUS FOR USE IN APPLYING PANTS TO THE LEGS OF A WEARER

This invention relates to a Method and Apparatus for use in applying pants to the legs of a wearer.

BACKGROUND OF THE INVENTION

The apparatus herein is designed to assist people of any age by making the task of sliding their foot into their pant legs easier.

When putting on "distressed" (ripped) jeans or pants, it is not uncommon for one's foot to get caught on the many catching points on the way down from the waist to the ankle. These types of fashionable pants are very expensive as the holes, tears and weakened areas are strategically placed on the pant legs. Having one's foot getting caught as the pants are being put on can easily create a hole where there previously wasn't one, or enlarge a hole to the point where the pants lose their fashion effect.

Elderly people, people with disabilities and those recovering from injury can all benefit from daily living aid products and devices to help make everyday tasks easier.

Many foot problems arise as we age. Elderly people may suffer from bunions, hammertoes, edema and reduced foot flexion making the routine task of putting pants on a difficult procedure.

Foot drop (aka drop foot) is a mobility disability resulting from an underlying neurological or muscular injury that affects millions of people nationwide each year. People who have foot drop cannot lift the front of their feet due to weakness or paralysis of the muscles in the feet. This can make it difficult to put their foot through the legs of their pants while getting dressed.

Injuries where one might have a foot in a cast, orthopedic brace, compression stocking etc. can cause difficulties in putting on a pair of pants because of the device size, material, or the type of fastener (i.e. Velcro) that can get caught up on the pant fabric.

SUMMARY OF THE INVENTION

According to the invention there is provided a method for use in applying pants to the legs of a wearer comprising:

- providing a semi-rigid elongate body formed of a thin smooth sheet material;
- the body having an upper end and a lower end arranged to allow the body to be inserted into a pant leg along a front face of the pant leg;
- the body being convex in transverse cross-section so that the body engaging the front face holds the pant leg open for insertion of a foot of the wearer;
- the body having a length to extend from the crotch of the pants at least to the knee of the pant leg;
- the body having a hand grasping portion at or adjacent the upper end by which the body can be manually maneuvered into the pant leg to hold open the pant leg and to protect the pant leg from damage during insertion of the foot;
- while holding the hand grasping portion, inserting the lower end of the body into the pant leg from the crotch to a position below the knee;
- and locating the body between the foot and the pant leg while inserting the foot.

Preferably the body has a length of at least 18 inches and a width of at least 6 inches. the length can be as much as 30 inches so as to reach almost to the foot of the wearer.

Preferably the body tapers inwardly from the upper end toward the lower end so as to allow easier insertion into the pant leg. The upper end may therefore be around 8 inches with a taper to the lower end to around 6 inches.

Preferably the body extends around at least 120 degrees and possibly as much as 180 degrees so as to form a sleeve into which the foot is inserted.

Preferably the upper end is flatter and wider than a lower part of the body and preferably the lower end has a smaller radius of curvature than the upper end.

Preferably the hand grasping portion comprises a handle hole through the body adjacent the upper edge.

Preferably the handle hole includes a sleeve portion at least partly surrounding the handle hole which projects from the body. In this way the sleeve portion provides a flange on the surface facing outwardly on which the thumb of the user can be engaged to better control the movement of the body during insertion.

Preferably the body comprises a thin smooth sheet material.

Preferably the method operates in some cases so that distressed holes in the front face of the pant leg are protected from tearing by locating the body between the foot and the pant leg while inserting the foot.

Preferably the invention also provides an apparatus which is arranged and constructed to be used on the above method. The apparatus thus comprises:

- a semi-rigid elongate body formed of a thin smooth material;
- the body having a generally tapered lower end allowing the body to be inserted into a pant leg along a front face of the pant leg;
- the body being convex in transverse cross-section so that the body engaging the front face holds the pant leg open for insertion of a foot of the wearer;
- the body having a length to extend from the crotch of the pants at least to the knee of the pant leg and typically longer to a position adjacent the foot;
- the body having a hand grasping portion at an upper end by which the body can be manually maneuvered into the pant leg to hold open the pant leg and to protect the pant leg from damage during insertion of the foot.

The Pant-Leg device not only protects the pant leg from damage during insertion of the foot, but also that it allows for easier passage through the pant leg as in the case of a cast, brace, orthotic etc.

Preferably the body has a length of at least 18 inches so as to reach from the crotch to a position below the knee.

Preferably the body has a width of at least 6 inches so as to hold the leg open but also to be able to slide into narrow pant leg.

Preferably the body tapers inwardly from the upper end toward the lower end so as to be easily inserted, with the lower end being of the order of 4 inches across.

Preferably the body extends around at least 120 degrees and sometimes as much as 180 degrees so as to form a sleeve into which the foot is inserted.

Preferably the upper end is flatter and wider than a lower part of the body.

DETAILED DESCRIPTION

The arrangement is provided for use in applying pants to the legs of a wearer and comprises a semi-rigid elongate body 10 formed of a thin smooth sheet material 11.

Figure 8:
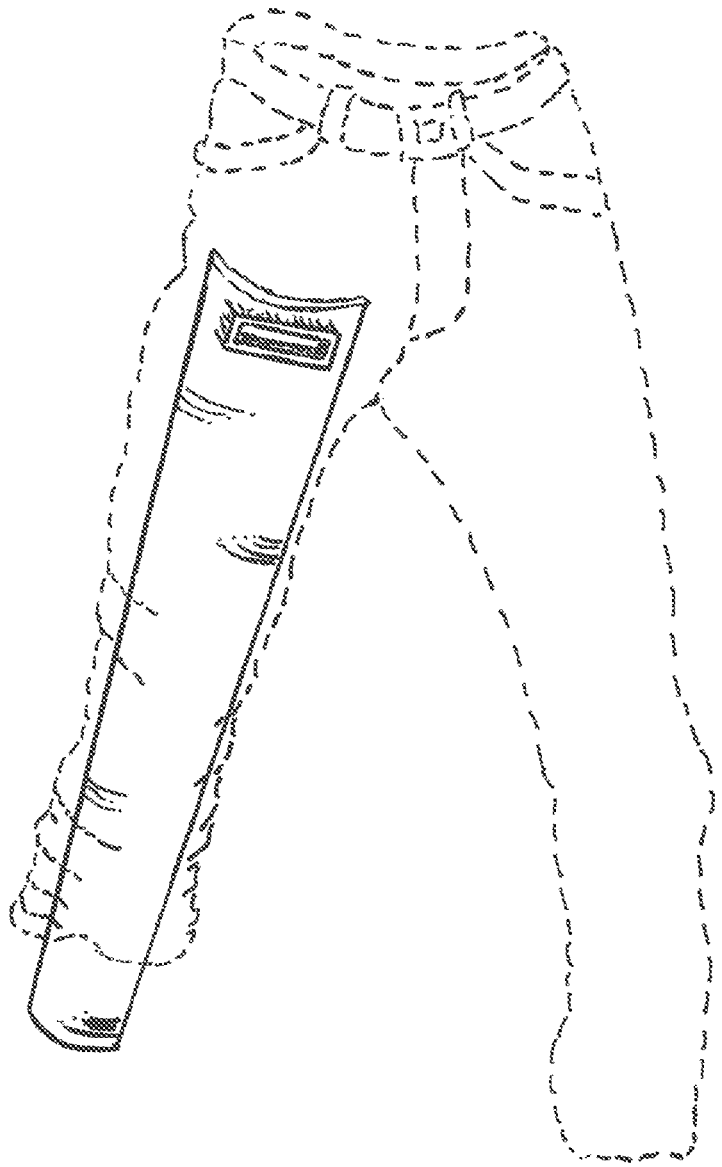
FIG. 8 is an isometric view taken from FIG. 1 showing the insertion into the pant leg of the pants.

The body has an upper end 12 and a lower end 13 arranged to allow the body to be inserted into a pant leg along a front face of the pant leg as shown in FIG. 8.

The body is convex in transverse cross-section to form a curved front surface 15 and a concave rear surface 16 so that the body engaging the front face 15 holds the pant leg open for insertion of a foot of the wearer. The body has a length of around 18 inches to extend from the crotch of the pants at least to the knee of the pant leg. The body has a width of at least 6 inches at the upper end so as to provide a width to receive and guide the foot of the wearer into the pant leg without slipping to one side.

The body has a hand grasping portion 20 at or adjacent the upper end 12 by which the body can be manually grasped and maneuvered into the pant leg to hold open the pant leg and to protect the pant leg from damage during insertion of the foot. The hand grasping portion comprises a handle hole through the body adjacent the upper edge which is at least partly surrounded by a flange forming a rectangular sleeve portion at least partly surrounding the handle hole which projects from the front surface of the body.

In operation, while holding the hand grasping portion, the user inserts the lower narrower end of the body into the pant leg from the crotch to a position below the knee and locates the body between the foot and the pant leg while inserting the foot.

The body thus tapers inwardly from the upper end toward the lower end. The body typically extends around at least 180 degrees so as to form a sleeve into which the foot is inserted. As shown the upper end is flatter and wider than a lower part of the body and the lower end has a smaller radius of curvature than the upper end.

The body is typically formed from a thin smooth sheet material.

In this way, when used by able persons for fashion items distressed holes in the front face of the pant leg are protected from tearing by locating the body between the foot and the pant leg while inserting the foot.

Figure 1:
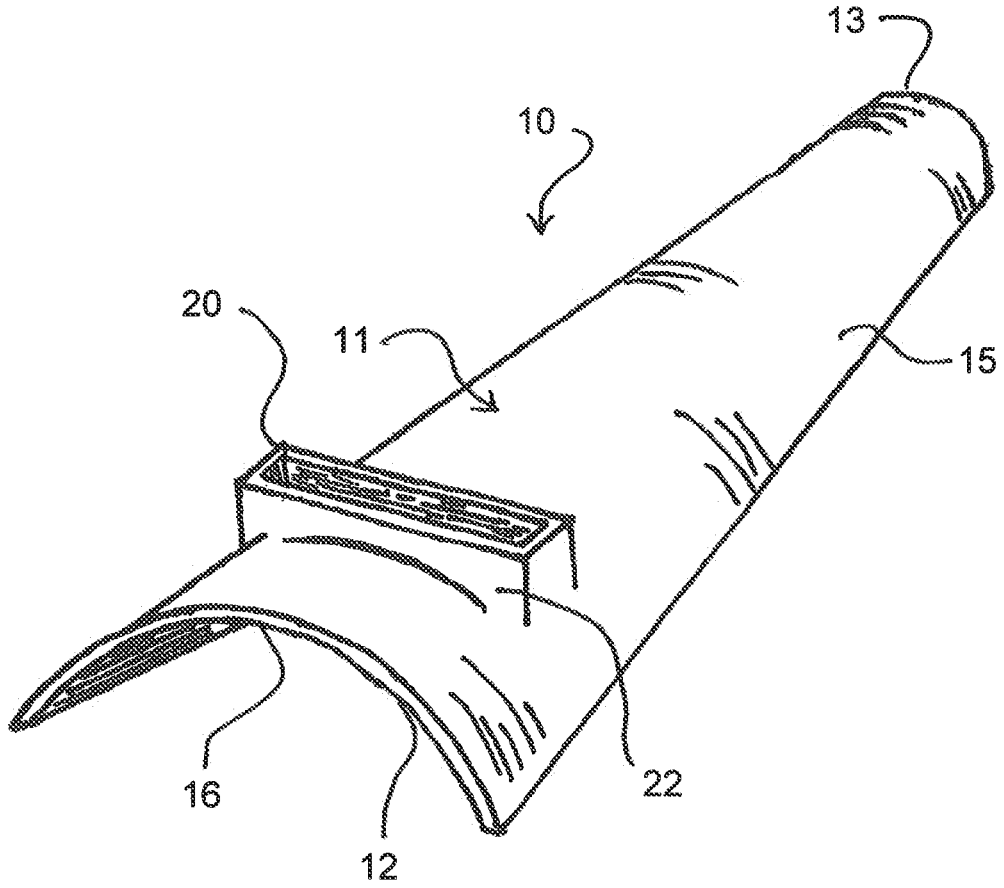
FIG. 1 is an isometric view of the embodiment according to the invention showing the details of the design.
Figure 2:
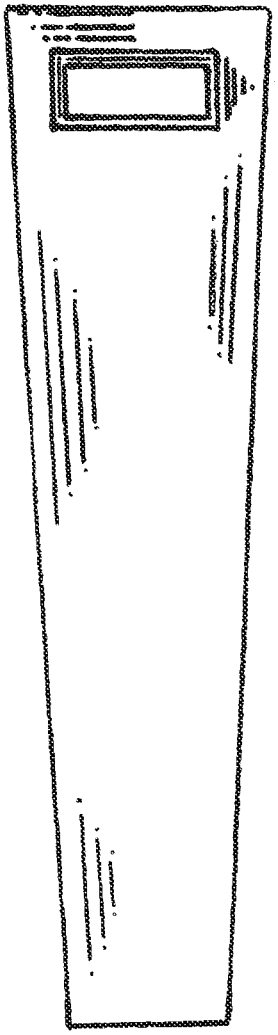
FIG. 2 is a front elevational view of the embodiment according to the invention of FIG. 1.
Figure 3:
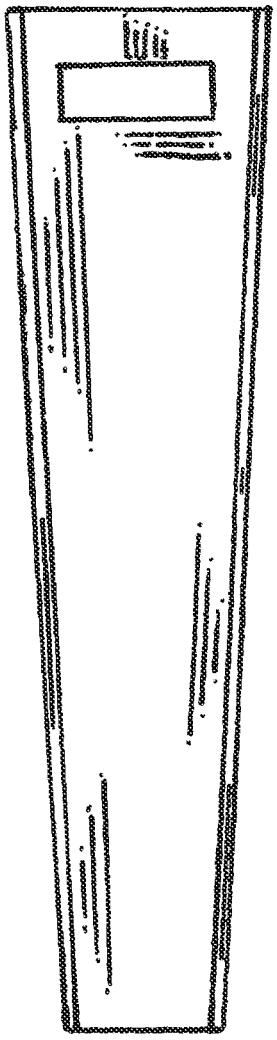
FIG. 3 is a rear elevational view of the embodiment according to the invention of FIG. 1.
Figure 4:
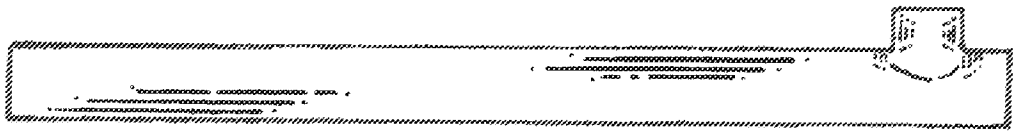
FIG. 4 is a first side elevational view of the embodiment according to the invention of FIG. 1.
Figure 5:
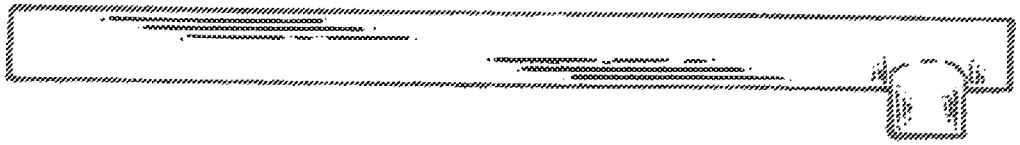
FIG. 5 is second side elevational view of the embodiment according to the invention of FIG. 1.
Figure 6:
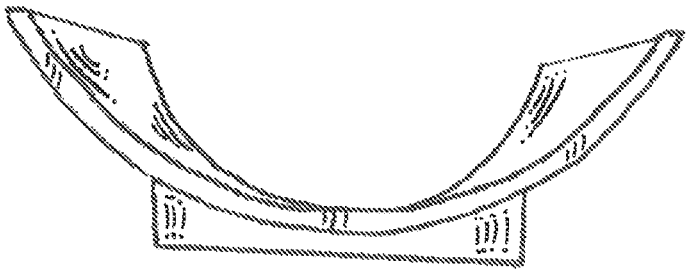
FIG. 6 is a top plan view of the embodiment according to the invention of FIG. 1.
Figure 7:
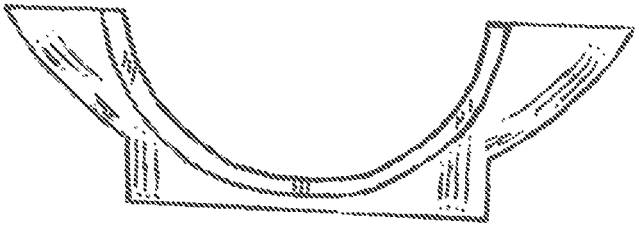
FIG. 7 is a bottom plan view of the embodiment according to the invention of FIG. 1.

Simply slide the device herein (see FIG. 1. and FIG. 8.) into one of the legs of the pair of pants and push it until the bottom nears the cuff of the pants. The curve will follow the contour of the pant leg by wrapping from side to side while covering the inside front of the pants. The foot and leg can now be inserted, and slid along the smooth surface of the device herein without fear of anything being caught up. Once the foot is nearing the exit point at the ankle of the pants, the device herein can slowly be withdrawn by gently pulling up on the hand size opening at the upper, wider end of the device.

Ideally it would reach lower to facilitate foot passage right through the entire pant leg, as in the case of foot problems, casts, braces etc., the need would be to have the "sleeve" assist through the full distance. As described above and as shown in FIGS. 1 and 8 the body forms a single sheet of the sheet material which extends from a position at or above the crotch to a position below the knee. The single sheet of the body extends around the front face of the pant leg in an angle in the range 120 degrees to 180 degrees so that during insertion the rear face of the pant leg is unsupported by and free from engagement with the body and so that the foot slides into the pant leg along the body and along the rear face of the pant leg.

The invention claimed is:

1. A method for use in applying pants to the legs of a wearer comprising:

providing a semi-rigid elongate body formed of a thin smooth sheet material;

the body having an upper end and a lower end arranged to allow the body to be inserted into a pant leg along a front face of the pant leg;

where the body tapers inwardly from the upper end toward the lower end;

the body being convex in transverse cross-section so that the body engaging the front face holds the pant leg open for insertion of a foot of the wearer;

the body having a length to extend from the crotch of the pants at least to the knee of the pant leg;

the body having a hand grasping portion at or adjacent the upper end by which the body can be manually maneuvered into the pant leg to hold open the pant leg and to protect the pant leg from damage during insertion of the foot;

while holding the hand grasping portion, inserting the lower end of the body into the pant leg from the crotch to a position below the knee;

and locating the body between the foot and the pant leg while inserting the foot.

2. The method according to claim 1 wherein the body has a length of at least 18 inches.

3. The method according to claim 1 where the body has a width of at least 6 inches.

4. The method according to claim 1 where the body extends around at least 120 degrees so as to form a sleeve into which the foot is inserted.

5. The method according to claim 1 where the upper end of the body is wider than the lower end of the body.

6. The method according to claim 1 where the lower end of the body has a smaller radius of curvature than the upper end of the body.

7. The method according to claim 1 wherein the hand grasping portion comprises a handle hole through the body adjacent the upper edge and wherein the handle hole includes a sleeve portion at least partly surrounding the handle hole which projects from the body.

8. The method according to claim 7 wherein the sleeve portion projects forwardly from a front face of the body.

9. The method according to claim 1 where the body comprises a single sheet of a thin smooth sheet material.

10. The method according to claim 1 including protecting distressed holes in the front face of the pant leg from tearing by locating the body between the foot and the distressed holes in the pant leg while inserting the foot.

11. A method for use in applying pants to the legs of a wearer comprising:

providing a semi-rigid elongate body formed of a thin smooth sheet material;

the body having an upper end and a lower end arranged to allow the body to be inserted into a pant leg along a front face of the pant leg;

the body being convex in transverse cross-section so that the body engaging the front face holds the pant leg open for insertion of a foot of the wearer;

wherein the lower end has a smaller radius of curvature than the upper end;

the body having a length to extend from the crotch of the pants at least to the knee of the pant leg;

the body having a hand grasping portion at or adjacent the upper end by which the body can be manually maneuvered into the pant leg to hold open the pant leg and to protect the pant leg from damage during insertion of the foot;

while holding the hand grasping portion, inserting the lower end of the body into the pant leg from the crotch to a position below the knee;

and locating the body between the foot and the pant leg while inserting the foot.

12. The method according to claim 11 where the upper end is wider than the lower end.

13. A method for use in applying pants to the legs of a wearer comprising:

providing a semi-rigid elongate body formed of a thin smooth sheet material;

the body having an upper end and a lower end arranged to allow the body to be inserted into a pant leg with a front face of the body along a front face of the pant leg;

the body being convex in transverse cross-section so that the body engaging the front face of the pant leg holds the pant leg open for insertion of a foot of the wearer;

the body having a length to extend from the crotch of the pants at least to the knee of the pant leg;

the body having a hand grasping portion at or adjacent the upper end by which the body can be manually maneuvered into the pant leg to hold open the pant leg and to protect the pant leg from damage during insertion of the foot;

wherein the hand grasping portion comprises a handle hole through the body adjacent the upper end and a sleeve portion at least partly surrounding the handle hole which projects from the body;

while holding the hand grasping portion, inserting the lower end of the body into the pant leg from the crotch to a position below the knee;

and locating the body between the foot and the pant leg while inserting the foot.

14. The method according to claim 13 wherein the sleeve portion projects forwardly from the front face of the body.

15. A method for use in applying pants to the legs of a wearer comprising:

the pants having two pant legs connected at a crotch with each pant leg having a front face and a rear face;

providing a semi-rigid elongate body formed of a single sheet of a thin smooth sheet material;

the body having an upper end and a lower end arranged to allow the body to be inserted into a pant leg along a front face of the pant leg;

the body being convex in transverse cross-section so that the body engaging the front face holds the pant leg open for insertion of a foot of the wearer into the pant leg;

the body having a hand grasping portion at or adjacent the upper end by which the body can be manually maneuvered into the pant leg to hold open the pant leg and to protect the pant leg from damage during insertion of the foot;

while holding the hand grasping portion, inserting the lower end of the body into the pant leg so that the single sheet of the body extends from a position at or above the crotch to a position below the knee;

the single sheet of the body extending around the front face of the pant leg in an angle in the range 120 degrees to 180 degrees so that the rear face of the pant leg is unsupported by and free from engagement with the body;

and locating the body between the foot and the front face of the pant leg while inserting the foot so that the foot slides into the pant leg along the body and along the rear face of the pant leg.

16. The method according to claim 15 where the upper end of the body is wider than the lower end of the body and the lower end of the body has a smaller radius of curvature than the upper end of the body.

17. The method according to claim 15 wherein the hand grasping portion comprises a handle hole through the body adjacent the upper end and wherein the handle hole includes a sleeve portion at least partly surrounding the handle hole which projects forwardly from a front face of the body.

18. The method according to claim 15 including protecting distressed holes in the front face of the pant leg from tearing by locating the body between the foot and the distressed holes in the pant leg while inserting the foot.

* * * * *